US008689463B2

(12) United States Patent
Poy

(10) Patent No.: US 8,689,463 B2
(45) **Date of Patent: *Apr. 8, 2014**

(54) CLOTHES DRYER APPARATUS WITH IMPROVED LINT REMOVAL SYSTEM

(75) Inventor: Russell Poy, New Orleans, LA (US)

(73) Assignee: Pellerin Milnor Corporation, Kerner, LA (US)

( * ) Notice: Subject to any disclaimer, the term of this patent is extended or adjusted under 35 U.S.C. 154(b) by 21 days.

This patent is subject to a terminal disclaimer.

(21) Appl. No.: 13/461,188

(22) Filed: May 1, 2012

(65) Prior Publication Data

US 2012/0304487 A1 Dec. 6, 2012

Related U.S. Application Data

(63) Continuation of application No. 12/421,040, filed on Apr. 9, 2009, now Pat. No. 8,166,670.

(60) Provisional application No. 61/043,576, filed on Apr. 9, 2008.

(51) Int. Cl.

| | |
|---|---|
| ***F26B 3/00*** | (2006.01) |
| ***F26B 17/00*** | (2006.01) |
| ***F26B 11/02*** | (2006.01) |
| ***F26B 21/06*** | (2006.01) |
| ***D06F 58/00*** | (2006.01) |

(52) U.S. Cl.

USPC ..... 34/595; 34/480; 34/588; 34/591; 34/82; 34/140

(58) Field of Classification Search

USPC ..... 34/282, 312, 313, 314, 315, 318, 319, 34/321, 322, 326, 327, 443, 467, 480, 487, 34/498, 499, 523, 576, 578, 579, 582, 583, 34/587, 588, 590, 591, 592, 593, 594, 58, 34/72, 79, 82, 85, 86, 108, 130, 132, 595, 34/139, 140

See application file for complete search history.

(56) References Cited

FOREIGN PATENT DOCUMENTS

EP 1380683 A2 * 1/2004 ..... D06F 58/22

* cited by examiner

*Primary Examiner* — Philip Tucker
*Assistant Examiner* — Brian R Slawski
(74) *Attorney, Agent, or Firm* — Garvey, Smith, Nehrbass & North, L.L.C.; Charles C. Garvey, Jr.; Vanessa M. D'Souza

(57) ABSTRACT

A method and apparatus for removing lint from air that is discharged from a clothes dryer uses a lint filtration housing mounted on the frame of the clothes dryer, the filtration housing having an interior that contains a filter for removing lint from the dryer exhaust air flow stream. The housing provides an influent fitting for transmitting heating exhaust air from the drying chamber to the housing interior. An ambient air supply enables ambient air to be added to the filtration housing interior. One or more vanes is provided that create an annular vortex within the filtration housing interior. The flow of the annular vortex within the filtration housing interior can be between about 500 and 3,000 cubic feet per second. A flow line transmits pre-heated air from the filtration housing interior to the dryer interior.

24 Claims, 1 Drawing Sheet

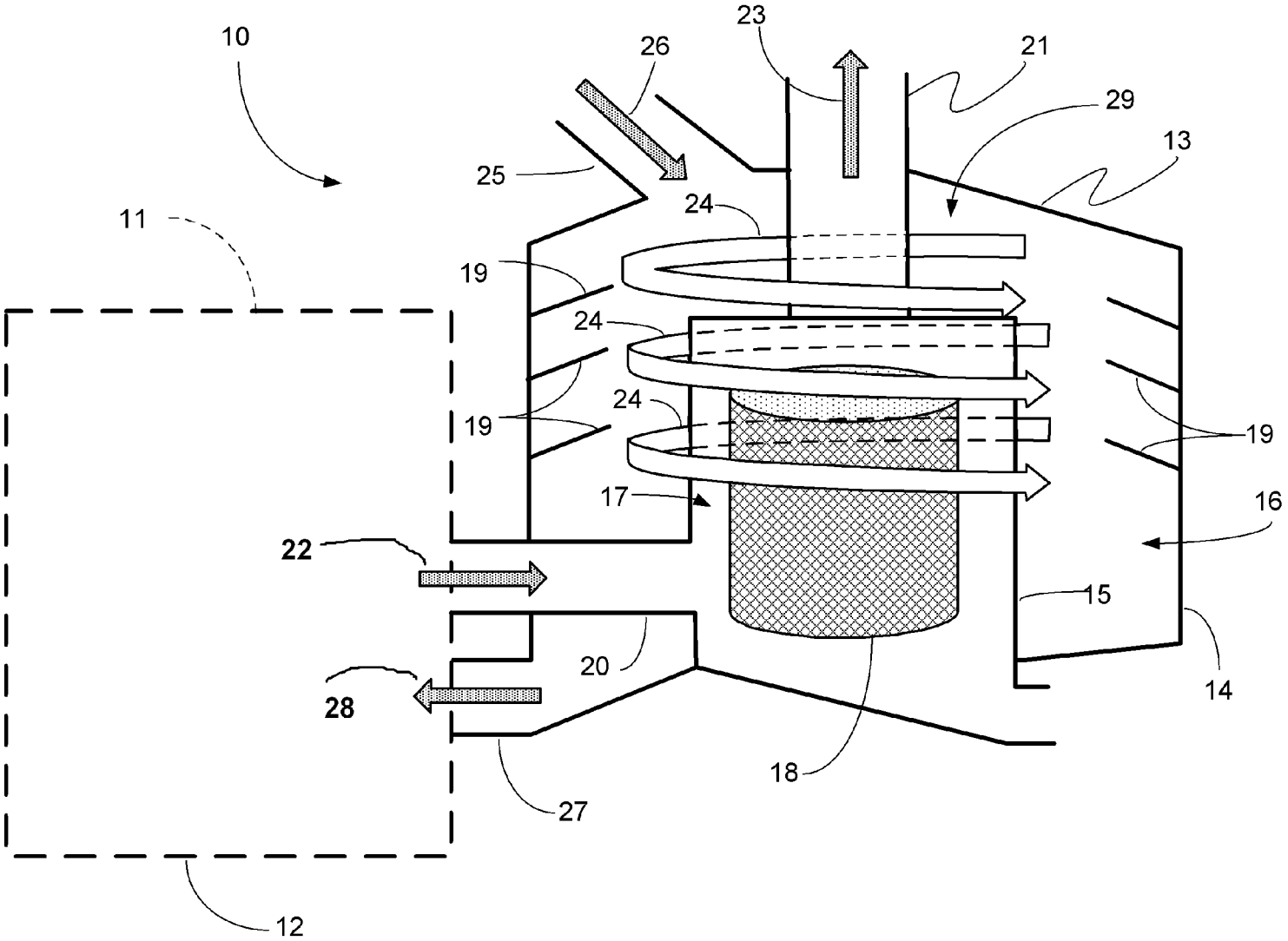
10
11
12
13
14
15
16
17
18
19
20
21
22
23
24
25
26
27
28
29

CLOTHES DRYER APPARATUS WITH IMPROVED LINT REMOVAL SYSTEM

CROSS-REFERENCE TO RELATED APPLICATIONS

This is a continuation of U.S. patent application Ser. No. 12/421,040, filed Apr. 9, 2009 (issuing as U.S. Pat. No. 8,166,670 on May 1, 2012), which is a non-provisional patent application of U.S. Provisional Patent Application Ser. No. 61/043,576, filed Apr. 9, 2008, each of which is incorporated herein by reference.

Priority of U.S. Provisional Patent Application Ser. No. 61/043,576, filed Apr. 9, 2008, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to lint collectors for industrial clothes dryers and more particularly to an improved method and apparatus for removing lint from the exhaust air stream of an industrial clothes dryer. Even more particularly, the present invention relates to a method and apparatus for removing lint from the exhaust air stream of an industrial clothes dryer wherein a lint collector is combined with an air heat exchanger that preheats the air supply to the same dryer using the energy from the exhaust stream air. In order to maximize the contact time of the air supply to the exhaust air and thereby maximize energy transfer, the design of the present invention reduces the air velocity of the air supply by creating a turbulent annular vortex.

2. General Background of the Invention

Current technology lint collectors for industrial dryers typically only perform the function of removing lint from the exhaust air stream. Many such industrial clothes dryers utilize separate filters and at times coaxial ducting. Such coaxial ducting and separate filters are costly and require extra space.

BRIEF SUMMARY OF THE INVENTION

The design of the present invention provides a lint collector with an air heat exchanger. The air heat exchanger preheats the air supply to the dryer thus using energy/heat from the exhaust stream air. In order to maximize the contact time of the air supply to the exhaust air and thus maximize energy transfer, the air velocity of the air supply is reduced by creating a turbulent annular vortex.

Because the lint filter of the present invention can be mounted directly on the clothes dryer chassis, frame or housing, it saves space and cost compared to separate filters and coaxial ducting.

The design of the present invention is more efficient in recovering energy because of the low air flow velocity and the use of a vortex, when compared to coaxial ducting.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 1 is a schematic diagram of the preferred embodiment of the apparatus of the present invention.

DETAILED DESCRIPTION OF THE INVENTION

FIG. 1 shows the preferred embodiment of the apparatus of the present invention, designated generally by the numeral 10. Clothes drying apparatus 10 provides a frame or chassis 11. The chassis 11 contains a known clothes drying chamber 12 that typically rotates when clothes are drying. Frame or chassis 11 can support filtration housing 13. The filtration housing 13 can be mounted directly on the clothes dryer frame or chassis 11, saving space and cost when compared to separate filters and coaxial ducting.

Filtration housing 13 provides an outer wall 14 surrounding an interior 29 that can include an inner chamber 17 and an outer chamber 16. In FIG. 1, baffle 15 separates filtration housing interior 29 into inner chamber 17 and outer chamber 16.

Filter or filter screen 18 is contained within inner chamber 17 as shown in FIG. 1. Outer chamber 16 supports one or more annular vanes 19 (e.g. mounted on wall 14) that help create vortex flow within outer chamber 16.

Hot exhaust air duct 20 provides an influent fitting for communicating hot exhaust air from dryer chamber 12 to inner chamber 17. The heated exhaust air from dryer chamber 12 is filtered at filter screen or filter 18 to remove lint. Once filtered, the hot exhaust air exits filtration housing 13 via exhaust air discharge fitting 21 as illustrated by arrow 23 in FIG. 1. Arrow 22 illustrates the transmittal of heated exhaust air from clothes drying chamber 12 to inner chamber 17.

Ambient temperature air is supplied to filtration housing 13 and more particularly to outer chamber 16 via ambient air influent fitting 25. Arrow 26 in FIG. 1 illustrates the inflow of ambient temperature air through influent fitting 25 to outer chamber 16. Annular vanes 19 create a vortex flow of the influent ambient temperature air within outer chamber 16 as illustrated by arrows 24 in FIG. 1. Because inner chamber 17 is heated with exhaust air from drying chamber 12, heat transfer warms the ambient temperature air that enters at fitting 25 and that exits at return duct 27. Thus a preheated air supply is provided to clothes drying chamber 12 as illustrated by arrow 28 in FIG. 1. This flow path of influent ambient temperature air is indicated sequentially by arrows 26, 24 and (after heating in outer chamber 16) 28.

In order to maximize the contact time of the ambient air supply to clothes drying chamber 12, the vanes 19 create a vortex. The vortex reduces air velocity in the outer chamber 16 enhancing the chance for heat transfer between inner chamber 17 and outer chamber 16. The preheated air supply to dryer chamber 12 is efficient in recovering energy because of the low air velocity (for example, between about 500 and 2,500 cubic feet per second) and the use of vortexes compared to prior art coaxial ducting.

The following is a list of parts and materials suitable for use in the present invention.

PARTS LIST

| Part Number | Description |
|---|---|
| 10 | dryer apparatus |
| 11 | frame/chassis |

-continued

PARTS LIST

| Part Number | Description |
|---|---|
| 12 | clothes drying chamber |
| 13 | filtration housing |
| 14 | outer wall |
| 15 | baffle |
| 16 | outer chamber |
| 17 | inner chamber |
| 18 | filter/filter screen |
| 19 | annular vane/vanes |
| 20 | hot exhaust air duct/influent fitting |
| 21 | exhaust air discharge fitting |
| 22 | arrow |
| 23 | arrow |
| 24 | arrow |
| 25 | ambient air influent fitting |
| 26 | arrow |
| 27 | return duct |
| 28 | arrow |
| 29 | interior |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A clothes drying apparatus, comprising:

a) a clothes dryer having a frame that supports a drying chamber having an interior for containing clothes to be dried;

b) a lint filtration housing mounted on the frame, the lint filtration housing having a two part interior that includes an outer part and an inner part that contains a filter for removing lint from a dryer exhaust air flow stream;

c) the housing having a channel for transmitting heated exhaust air from the drying chamber to the housing interior inner part;

d) an ambient air supply that enables ambient air to be added to the filtration housing interior outer part;

e) the housing being shaped to create an annular vortex within the filtration housing interior externally of the filter;

f) a flow line that transmits preheated air from the filtration housing interior to the inner part of the dryer interior; and g) wherein heat transfer from the inner part to the ambient air in the outer part is via a baffle wall which is heated by the exhaust air in the inner part.

2. The clothes drying apparatus of claim 1 wherein the housing has multiple annular vanes.

3. The clothes drying apparatus of claim 2 wherein the filtration housing has an inner wall and one or more of said vanes are attached to the inner wall.

4. The clothes drying apparatus of claim 2 wherein the filtration housing has an inner wall and one or more of said vanes are attached to the inner wall and spaced away from the inner part.

5. The clothes drying apparatus of claim 1 wherein in order to maximize heat transfer within the filtration housing, air velocity is reduced by the creation of the vortex so that air velocity within the filtration housing is lower than the air velocity of the heated exhaust at the channel.

6. The clothes drying apparatus of claim 1 wherein the filter is a filter screen.

7. The clothes drying apparatus of claim 1 wherein the baffle wall separates the filtration housing interior into inner and outer chambers, the inner chamber being a filter chamber.

8. The clothes drying apparatus of claim 7 wherein the filtration housing outer chamber contains one or more vanes.

9. The clothes drying apparatus of claim 7 wherein the filtration housing outer chamber contains vanes.

10. The clothes drying apparatus of claim 1 wherein housing has an outer chamber and the filtration chamber is an inner chamber, wherein the filtration housing inner chamber receives the heated exhaust air from the drying chamber.

11. The clothes drying apparatus of claim 7 wherein the filtration housing inner chamber discharges heated exhaust from the drying chamber after the filter removes lint from the heated exhaust air.

12. The clothes drying apparatus of claim 7 wherein the filtration housing outer chamber generally surrounds the inner chamber.

13. The clothes drying apparatus of claim 1 wherein air flow within the housing is between about 500 and 3,000 cubic feet per second.

14. A method of removing lint from a clothes drying apparatus, comprising the steps of:

a) providing a clothes dryer having a frame that supports a drying chamber, the drying chamber having an interior for containing clothes to be dried;

b) providing a lint filtration housing, the filtration housing having an inner part and an outer part with an interior that contains a filter chamber with a filter for removing lint from a dryer exhaust air flow stream the inner and outer parts being separated by a separating wall;

c) transmitting heated exhaust air from the drying chamber to the filter chamber;

d) enabling ambient air to be added to the outer part;

e) transmitting preheated air from the filtration housing interior to the dryer interior via an exhaust flow line; and f) transferring heat from the inner part to the ambient air in the outer part via the separating wall.

15. The method of claim 14 further comprising the step of creating a vortex within the outer part.

16. The method of claim 15 wherein the housing outer part has an inner wall and further comprising attaching vanes to the inner wall.

17. The method of claim 15 wherein the vortex is a turbulent vortex.

18. The method of claim 15 wherein in order to maximize heat transfer within the filtration housing, air velocity is reduced by the creation of the vortex so that air velocity within the filtration housing is lower than the air velocity of the preheated air in the exhaust flow line of step "e".

19. The method of claim 14 wherein the filter is a filter screen.

20. The method of claim 14 wherein the filtration housing outer part contains one or more vanes.

21. The method of claim 14 wherein in step "e" the filtration housing inner part receives the heated exhaust air from the drying chamber.

22. The method of claim 14 further comprising discharging heated exhaust from the drying chamber in step "e" after the filter removes lint from the heated exhaust air.

23. The method of claim 14 wherein the outer part generally surrounds the inner part.

24. The method of claim 14 further comprising the step of transmitting air flow within the filtration housing between about 500 and 3,000 cubic feet per second.

* * * * *